United States Patent [19]

Valencic et al.

[11] Patent Number: 4,910,863

[45] Date of Patent: Mar. 27, 1990

[54] METHOD OF MAKING AN AMORPHOUS METAL TRANSFORMER

[75] Inventors: Milan D. Valencic; Frank H. Grimes, both of Athens, Ga.

[73] Assignee: Asea Brown Boveri Inc., Purchase, N.Y.

[21] Appl. No.: 304,618

[22] Filed: Feb. 1, 1989

[51] Int. Cl.[4] ..... H01F 41/02

[52] U.S. Cl. ..... 29/606; 29/609; 336/206

[58] Field of Search ..... 29/605, 606, 609; 336/205, 206; 156/187, 188

[56] References Cited

U.S. PATENT DOCUMENTS

| | | | |
|---|---|---|---|
| * 2,386,904 | 10/1945 | Mayberry . | |
| 2,623,920 | 12/1952 | Ford . | |
| 2,994,634 | 8/1961 | Jayne . | |
| 3,467,932 | 9/1969 | Feather . | |
| 3,602,814 | 8/1971 | Quirk . | |
| 3,657,808 | 4/1972 | Zickar . | |
| 3,707,692 | 12/1972 | Reeder . | |
| 3,710,293 | 1/1973 | Lazor . | |
| 3,789,337 | 1/1974 | Sheppard . | |
| 4,516,104 | 5/1985 | McDermott . | |
| 4,543,555 | 9/1985 | McDermott . | |
| 4,648,929 | 3/1987 | Siman . | |
| 4,656,452 | 4/1987 | Martin . | |
| 4,682,126 | 7/1987 | Milberger . | |
| 4,734,975 | 4/1988 | Ballard et al. | 29/606 |

*Primary Examiner*—Carl E. Hall

*Attorney, Agent, or Firm*—Joyce L. Morrison

[57] ABSTRACT

A method of making a transformer having an amorphous metal core uses resin coated substrate to reduce amorphous metal contaminants in the transformer coolant. The face of an annealed wound amorphous metal core is covered with a resin coated substrate. The core and resin coated substrate are bonded by pressing the core face. The second face is then done in the same way. The resulting resin coated substrate and transformer core is a unit. The substrate prevents amorphous metal pieces from escaping into the transformer oil and becomes a structural member of the core.

4 Claims, 3 Drawing Sheets

METHOD OF MAKING AN AMORPHOUS METAL TRANSFORMER

BACKGROUND OF THE INVENTION

1. Field of the Invention

The invention relates to transformers having amorphous metal cores, and particularly to such transformers having wound rectangular cores.

2. Description of the Prior Art

Despite its high cost, amorphous metal is gradually replacing electrical grade steel in transformer cores because it is a lower loss material than with regular grain oriented electrical steel. A wound core transformer can be made from amorphous metal by winding an amorphous metal sheet into a core over a two-piece inside mandrel or core support, cutting one leg of the core, and forming the metal into a generally rectangular shape. Magnetic cores wound from a strip of amorphous metal are not self-supporting and will collapse if not otherwise supported if the mold portion of the winding mandrel is removed from the core window. If an amorphous core is not operated in the as annealed configuration the core losses increase. The amorphous metal is annealed, which converts it into a very brittle material. Annealing optimizes the magnetic characteristics of the core. However, after annealing slivers and flakes of the amorphous metal may contaminate the liquid coolant.

There is a need for a high volume method of producing cores while resisting the presence of contaminants in the transformer coolant.

There remains a need for an economical high volume method of producing a self-supporting amorphous metal transformer.

DISCLOSURE OF THE INVENTION

It is an object of the present invention to make transformers having amorphous metal cores.

It is another object of the present invention to provide an economical method of manufacturing transformers having amorphous metal cores.

We have discovered that transformers having amorphous metal cores can be produced in such a way that damage to or by the amorphous metal core is minimized.

In this invention, the three legs of an amorphous metal core are enclosed on both sides or faces by a structural material to increase the structural strength of the core and to prevent the escape of fragments from the core.

The amorphous metal core is removed from the anneal process when the core is at a temperature of about 200° C. A porous material such as cotton cloth is placed over the joint area and a resin coated substrate is placed on the face of three legs of the core.

The core is placed in a press for sizing and consolidation of the resin coated substrate to the core. The core is removed from the press and edges of the resin coated material are cut and folded to overlap the core and the process is repeated on the other face of the core.

BRIEF DESCRIPTION OF THE DRAWINGS

The invention will become more apparent by reading the following detailed description in conjunction with the drawings, which are shown by way of example only, wherein.

DESCRIPTION OF THE PREFERRED EMBODIMENTS

In the method, as shown in FIGS. 1 through 4, the residual heat in the core after annealing is used to cure the adhesive-impregnated substrate to the core. The pressing process is performed after the core has been removed from anneal, preferably at a temperature of about 150° C. to 180° C.

Figure 1:
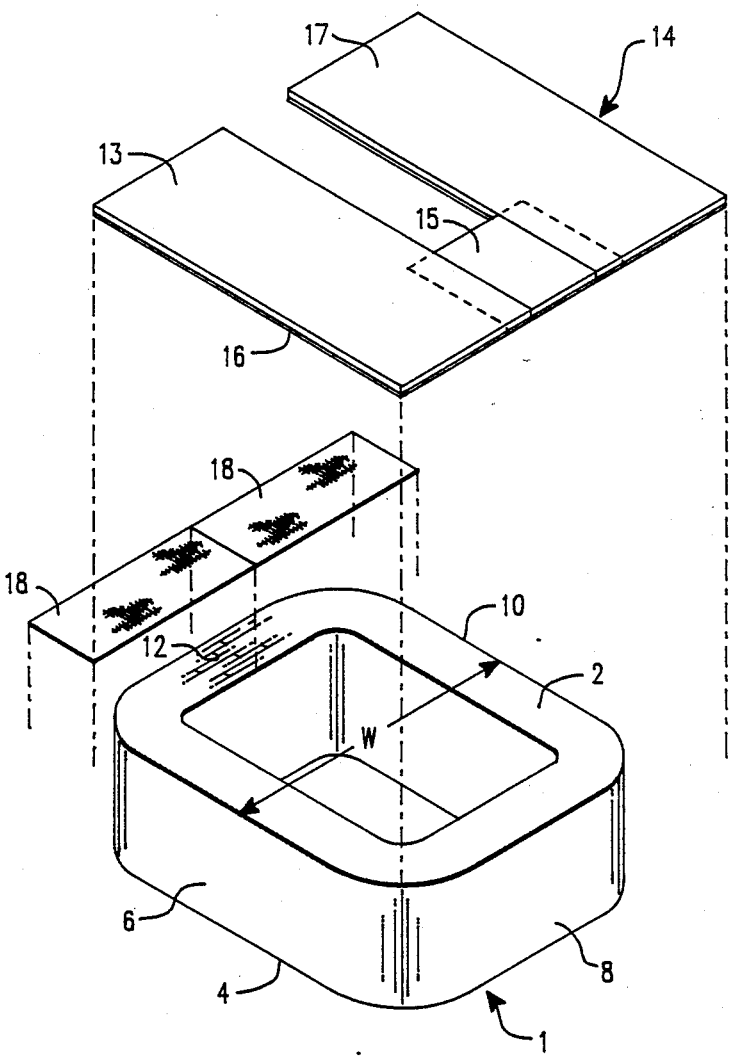
FIG. 1 is an exploded view showing a presently preferred embodiment of an amorphous metal core in an early stage of preparation according to the method of this invention.

FIG. 1 shows an amorphous metal core 1. A single core 1 is shown for purposes of illustration. However, multiple cores may be used in this invention. The core 1 is formed over a carbon steel mandrel (not shown) and may be placed in an electrical steel jacket (not shown) to further protect the amorphous metal. The core has two faces 2, 4 and three legs 6, 8, 10 and a core joint 12. A resin coated substrate 14 is in the process of being applied to a face 2 and three legs 6, 8, 10 of the core 1. The resin coated substrate 14 has a resinous material 16 applied to one side of the substrate. In a presently preferred embodiment, the resin coated substrate is made up of multiple components and in the case of FIG. 1, three components 13, 15, 17. In later steps, the multiple components allow for easier folding around the core. A porous substrate 18, such as woven cotton cloth, is used to cover the core joint 12.

Figure 2:
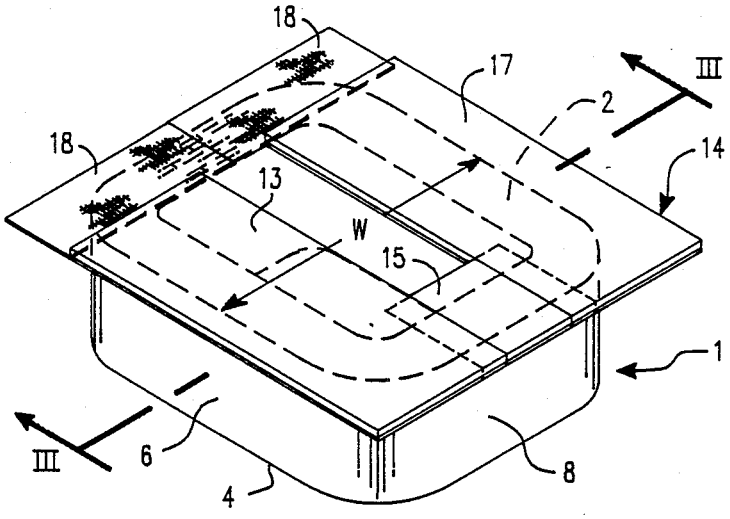
FIG. 2 is a view showing the elements of FIG. 1 being prepared for insertion into the press.

FIG. 2 shows the core 1 with the resin coated substrate 14 and the porous substrate 18 in position. The resin coated substrate 14 overlaps the porous substrate 18 by a fraction of an inch, approximately ½ inch.

Figure 3:
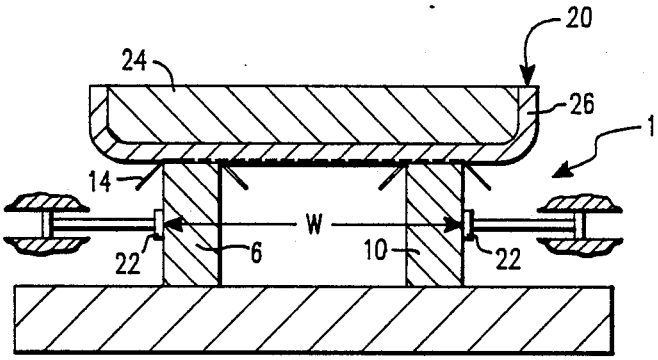
FIG. 3 shows a presently preferred embodiment of an amorphous metal core in the press according to a method of this invention.

FIG. 3 shows the resin coated substrate 14 being pressed onto the core 1 by a press 20. The press face 2 sizes the core 1 with sizing means 22, such as cylinders or drives. The resin coated substrate is pressed with a platen 24 having the ability to press against an irregular surface, substance 26 such as silicon rubber. The core remains in the press 20 for about 30 to 60 seconds.

Figure 4:
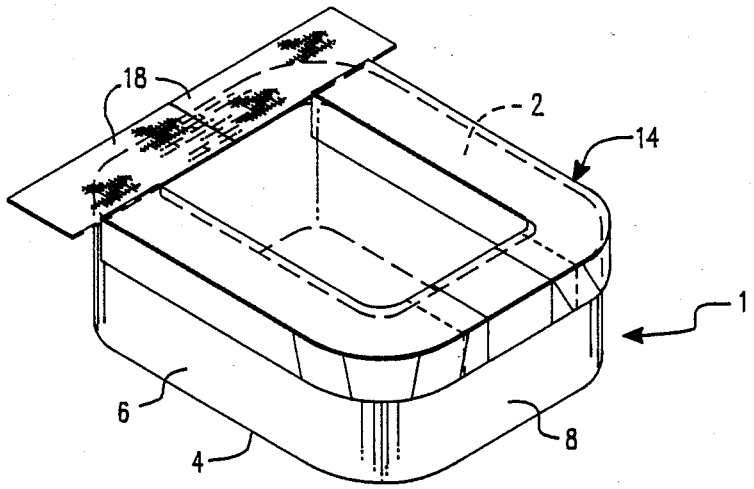
FIG. 4 shows the core of FIG. 1 after being pressed.

FIG. 4 shows the core after the adhesive impregnated substrate 14 has been cut and folded to the sides 6, 8, 10 of the core 1.

A second resin coated substrate (not shown) similar or identical to resin coated substrate 14 may be placed on the other face 4 of the core. Alternatively, the resin coated substrate 14 may be placed on both faces of the core and then pressed.

Woven cotton cloth is preferred as the porous substrate. The porous substrate 18 permits air trapped in the core to be replaced with oil when the core is placed in oil under vacuum, but does not permit particles of amorphous metal to pass into the oil outside the coil. If the air pressure in the core is not relieved, it stresses the core and impairs its magnetic properties.

Any resinous adhesive may be used that is compatible with the resin coated substrate and transformer oil may be used. It is preferred that thermally curable resins (such as B553, a trade product of Westinghouse Electric Corporation, Manor, Pennsylvania) be used. In a presently preferred embodiment, the adhesive is applied to the substrate prior to application to the core. The presently preferred substrate is Kraft paper impregnated with a thermally curable resin.

Any number of cores can be used in the transformer, and the invention is not intended to be limited to the two-legged core-form transformer shown in the drawings. For example, the invention is also applicable to shell-form transformers, where a single coil (having two or more windings) encircles the butted legs of two cores. The amorphous metal core need not be rectangular, but may have any other suitable shape, such as cruciform (rectangular, but with a circular cross-section) or torus (circular or oval with a rectangular or circular cross section).

The amorphous metal core may consist of a single corelette, or of multiple corelettes where a transformer of greater width is desirable than the available width of amorphous metal. Amorphous metal is a commercially available material sold by Allied Signal Corporation under the trade designation "METGLAS" in a nominal thickness of about 1 mil and a width of about 1 inch to about 8 inches. It is generally made of iron, boron, and silicon, and typically contains about 80% (by weight) iron, 14% boron, and 4% silicon, and may also contain carbon, nickel, and other elements. It is prepared by rapidly quenching a thin sheet of metal. (See U.S. Pat. No. 3,845,805, herein incorporated by reference, for additional information.) This invention is applicable to any type of transformer containing an amorphous metal core where the core is wound and cut, but the transformer is preferably a distribution oil-cooled transformer as the teachings of this invention are most applicable to this type of transformer.

It will be appreciated that we have developed a simple, quick, inexpensive method of manufacturing amorphous metal transformers. A resin coated substrate is applied to the faces of a transformer core to give the transformer core strength and for ease of manufacture and to resist the flow of amorphous metal pieces out of the unit.

Whereas particular embodiments of the invention have been described above for purposes of illustration, it will be appreciated by those skilled in the art that numerous variations of the details may be made without departing from the invention as described in the appended claims.

We claim:

1. A method of making a self-supporting transformer having a wound amorphous metal core, said core having two faces and a thermally curable adhesive resin coated substrate which prevents the escape of particles of said amorphous metal during operation thereof, comprising the steps of:

annealing said core at an elevated temperature in excess of 180° C.; substantially covering each face of said core with a respective one of said thermally curable adhesive resin coated substrates; pressing each of said thermally curable adhesive resin coated substrate against its respective face of said core, said covering and pressing occurring before said core has cooled below a post-anneal temperature of about 150° C. to 180° C. achieved during said annealing step whereby said thermally curable adhesive resin coated substrates are cured and become bonded to their respective faces and become structural members of said core.

2. A method according to claim 1 where said substrates comprise Kraft paper impregnated with a thermally curable adhesive resin.

3. A method according to claim 1 wherein said core has a rectangular crosssection, three legs and a cut leg, further including the step of placing a coil over each leg that adjoins said cut leg after pressing.

4. A method according to claim 3 including placing a porous material over said cut leg, after said faces of saic core are covered with said resin coated substrate.

* * * * *